US006616128B2

(12) United States Patent
Selzer

(10) Patent No.: US 6,616,128 B2
(45) Date of Patent: Sep. 9, 2003

(54) FIREFIGHTER'S WEDGE AND DEPLOYMENT ASSEMBLY THEREFOR

(76) Inventor: William L. Selzer, 707 N. 117th St., Wauwatosa, WI (US) 53226

( * ) Notice: Subject to any disclaimer, the term of this patent is extended or adjusted under 35 U.S.C. 154(b) by 0 days.

(21) Appl. No.: 09/998,344

(22) Filed: Nov. 30, 2001

(65) Prior Publication Data

US 2003/0102468 A1 Jun. 5, 2003

(51) Int. Cl.[7] ..... B66F 1/00

(52) U.S. Cl. ..... 254/104; 52/712; 52/512; 72/392

(58) Field of Search ..... 52/712, 126.1, 52/512; 72/392, 705; 254/104, 131, 42, 133 R, 93 R; 248/231.3, 188.2

(56) References Cited

U.S. PATENT DOCUMENTS

| | | | | | |
|---|---|---|---|---|---|
| 2,880,535 | A | * | 4/1959 | Bryant | 40/125 |
| 4,130,270 | A | * | 12/1978 | Andersson | 254/104 |
| 4,135,335 | A | | 1/1979 | Jensen | |
| 4,488,585 | A | | 12/1984 | Kendziorski | |
| 4,625,489 | A | * | 12/1986 | Bogle | 52/712 |
| 5,406,826 | A | * | 4/1995 | Kuhlmann | 72/392 |
| 6,311,537 | B1 | * | 11/2001 | Vigil | 72/392 |
| 6,363,244 | B1 | * | 3/2002 | Mcghee | 455/90 |
| 6,381,758 | B1 | * | 5/2002 | Roberts | 2/421 |
| 6,446,936 | B1 | * | 9/2002 | Ostrobrod | 254/368 |

* cited by examiner

*Primary Examiner*—George Nguyen
*Assistant Examiner*—Daniel Shanley
(74) *Attorney, Agent, or Firm*—Joseph S. Heino

(57) ABSTRACT

The assembly of the present invention provides a number of deployable wedges, each of which may incorporate a brightly colored, reflective surface to make the wedge easily locatable visually. Each wedge provides a series of alternating notches and ridges that are formed in opposing faces of each wedge to ensure positive engagement between a door and a doorframe. This notched configuration also ensures that one wedge, used in tandem with another wedge, is highly resistant to slippage of any kind between the two wedges. Each wedge utilizes a structural configuration that maximizes strength of the wedge while minimizing any extra weight, something that is to be avoided by firefighters who are already heavily burdened with other firefighting equipment and protective gear. This structural configuration allows each wedge to be used as a tool for turning a valve when such is desired or required. Lastly, the assembly of the present invention provides for a loop of rope to hook a wedge around a doorknob or the like, a rope clip, and a rope clip retention ring or a carabiner, or both, to readily and securely attach the assembly to a firefighter's belt.

21 Claims, 3 Drawing Sheets

FIREFIGHTER'S WEDGE AND DEPLOYMENT ASSEMBLY THEREFOR

FIELD OF THE INVENTION

The device of the present invention relates to the firefighting industry and to devices and products that are specifically designed to assist firefighters in the safe and efficient performance of their duties. More specifically, the device and assembly of the present invention provides a uniquely configured firefighter wedge and a system for carrying and quickly deploying a plurality of such wedges, each of which can be used alone or in combination with another wedge to hold even the heaviest doors open. Additionally, the wedge of the present invention may be brightly colored and/or reflective so as to serve as a marker to provide assurance that a room has been checked for fire and/or injured civilians.

BACKGROUND OF THE INVENTION

In the experience of this inventor, firefighters routinely carry one or more conventional wedges used for propping open doors, such wedges being tucked into pockets, strapped into helmet bands and suspended from strings attached to the firefighter's truck belt. Such wedges may also be used to "mark" rooms within a fire and smoke filled building to serve as a "room search indicator."

Also in the experience of this inventor, wedges of prior design do not satisfactorily or reliably perform the aforementioned functions. And there are several reasons that such is the case. First, prior wedges often have smooth surfaces. In fact, prior wedges are oftentimes crafted simply of wood or other similarly cheap and expendable material. The problem with such wedges is that their smooth surfaces do not adequately grip the surfaces of doors and door jams and, as a result, doors may close, particularly where a floor is made of well-worn wood, is painted or the coefficient of friction is otherwise relatively low.

Prior devices also lack the visually prominent color or reflective surfaces that may be incorporated into the device of the present invention. This important feature assists firefighters in visually marking rooms throughout the fire site when the wedge is suspended from a door knob or the like.

Also, prior devices generally consisted of systems simply "cobbled" together. The device of the present invention is purposely built to incorporate a design that provides, for each deployable wedge, a rope lanyard, and a carabineer, or a carabineer and a rope clip retention ring in combination or a rope clip retention ring by itself, to which a plurality of such lanyards and wedges are removably attachable by use of a rope clip. Each lanyard may be used to attach its respective wedge to the carabineer or to the rope clip retention ring. In the experience of this inventor, the preferred use is to clip the wedges directly to the carabiner, without the use of the rope clip retention ring. And, as previously described, each lanyard also provides a loop to encircle doorknobs and the like to indicate that a room has been searched. The carabiner is used to provide a quick and convenient way to attach the wedge deployment system to a firefighter's belt as well as to provide a quick release mechanism usable for a person wearing heavy gloves. The rope clip retention ring may, however, be used as a more permanent means of attaching the rope clips to a firefighter's belt.

SUMMARY OF THE INVENTION

The present invention has been designed and constructed to overcome some of the aforementioned shortcomings of the prior art. To that end, the device of the present invention provides a number of deployable wedges, each of which can incorporate a brightly colored, reflective surface to make the wedges more visually locatable. The device of the present invention also provides a series of notches that are formed in opposing faces of each wedge to ensure positive engagement between a door and a doorframe. This notched configuration also ensures that one wedge, used in tandem with another wedge, is highly resistant to slippage of any kind between the two wedges. The device of the present invention also utilizes a structural configuration that maximizes strength of the wedges while minimizing any extra weight, something that is to be avoided by firefighters who are already heavily burdened with other firefighting equipment and protective gear. This structural configuration allows each wedge to be used as a tool for turning a variety of valves, such as gas or water meter valves, when such is desired or required. Lastly, the device of the present invention provides for a loop of rope to hook a wedge around a doorknob or the like, a rope clip, a rope clip retention ring and/or a carabiner to readily and securely attach the assembly to a firefighter's belt.

DETAILED DESCRIPTION

Figure 8:
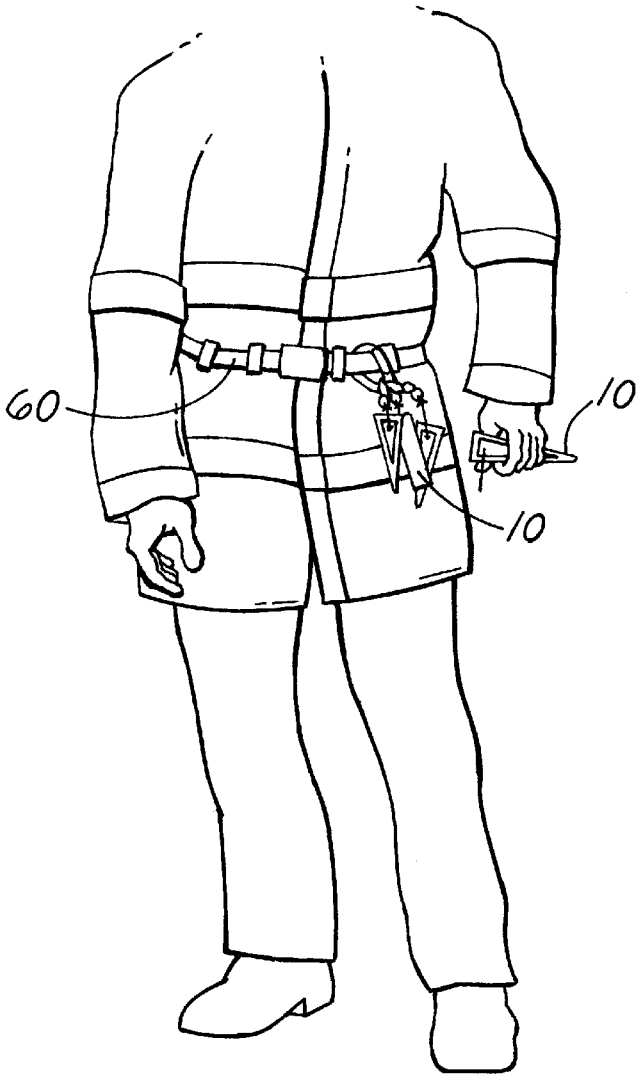
FIG. 8 illustrates use of the assembly of the present invention as it is attached to the belt of a firefighter.

Referring now to the drawings in detail, wherein like numbers represent like elements throughout, FIG. 8 illustrates a preferred embodiment of the firefighter's wedge and deployment assembly of the present invention. The device of the present invention provides a wedge deployment system and a plurality of wedges that are to be used by a firefighter to hold open doors, among other things. To this end, the device of the present invention, generally identified 1 provides an assembly consisting of a firefighter's wedge 10, a rope lanyard 20, a rope clip 30, a rope clip retention ring 40, and a carabiner 50. Although the assembly and preferred embodiment illustrated in FIG. 8 shows only one rope clip 30, one rope lanyard 20 and one wedge 10, it is understood that a plurality of each is intended to be suspended by a single rope clip retention ring 40 and a single carabiner 50. See FIG. 9 which illustrates this plural usage. It is also to be understood that a rope clip retention ring 40 may be used with or without the carabiner 50 and that a carabiner 50 may be used with or without the rope clip retention ring 40 and still come within the scope of this invention.

Figure 1:
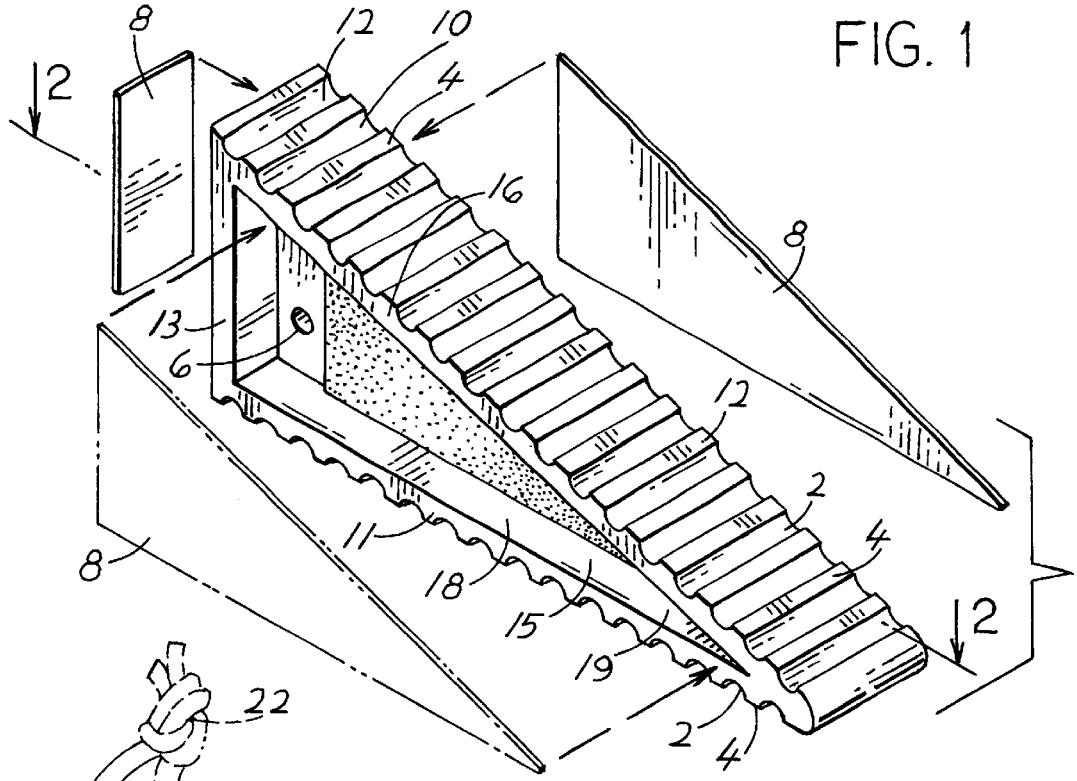
FIG. 1 is a left side, front and top perspective view of a wedge that is part of the assembly of the present invention.

The preferred embodiment of the firefighter's wedge 10 is in the shape of a right triangle, although other shapes, including all varieties of triangles and some trapezoids could even be used without departing from the scope of the present invention. In any case, the firefighter's wedge 10 of the present invention provides a first contact face 11 and a second contact face 12, the two contact faces 11, 12 laying generally in planes that form an acute angle between them. See FIG. 1. In the preferred embodiment, the first contact face 11 forms the base side of the right triangle and a third non-contact face 13 presents at a 90 degree angle to the first contact face 11. The second contact face 12 forms the slope between the first contact face 11 and the third non-contact face 13.

Figure 7:
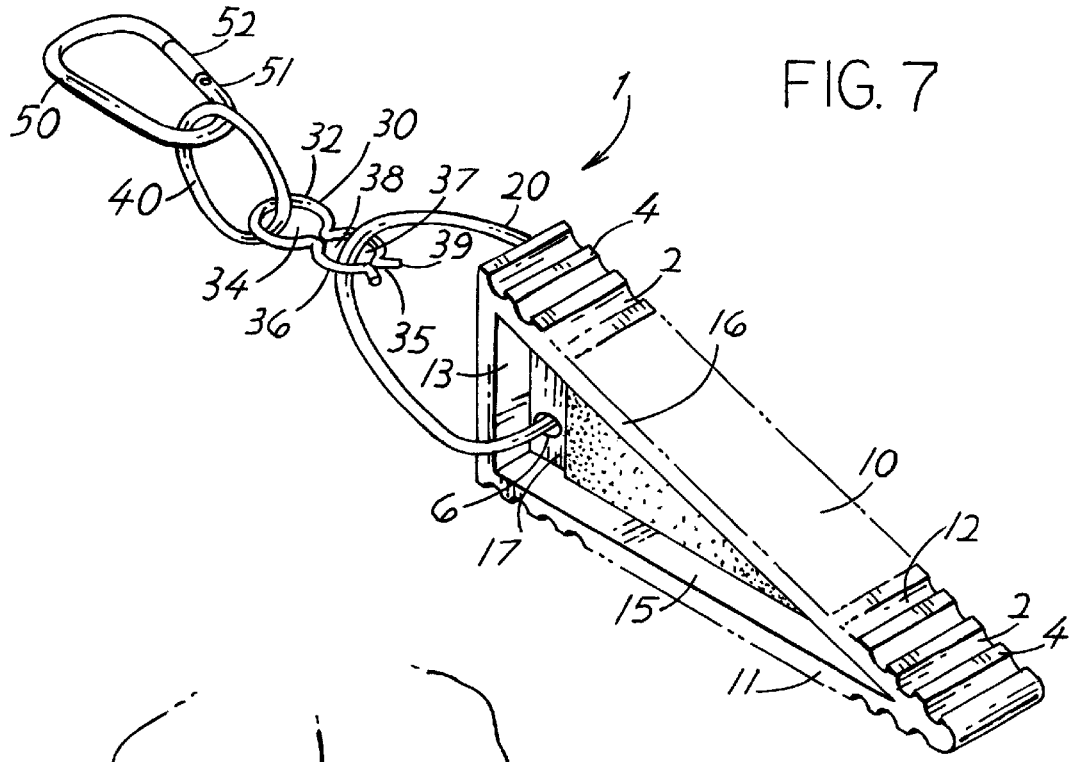
FIG. 7 is a left side, front and top perspective view of the assembly of the present invention but showing only one rope clip, rope lanyard and wedge attached to the carabiner and rope clip retention ring.

In the preferred embodiment, the two contact faces 11, 12 of the wedge 10 feature an alternating arcuate indentation 2 and ridge 4 design. This inventor has found that optimal performance of the wedge 10 occurs where the arcuate indentations 2 have a surface opening of 5 mm. and each ridge 4 has a length of 3 mm. The width of the wedge 10 is optimal at 25 mm. And is uniform along the width of each face 11, 12, 13. The arcuate indentation 2 and ridge 4 design of the preferred embodiment provides a multi-angled surface area for each contact face 11, 12 so that the wedge 10 can be easily positioned for maximum surface engagement between a door 70 and door jamb 72, for example. See FIG. 7. It is to be understood that many variations of this contact surface configuration may be possible. The arcuate indentations 2 do, however, allow the wedge 10 to pivot about a door edge, for example. The above example is meant to illustrate one of the possibilities and not to limit the invention to this particular arrangement.

Figure 2:
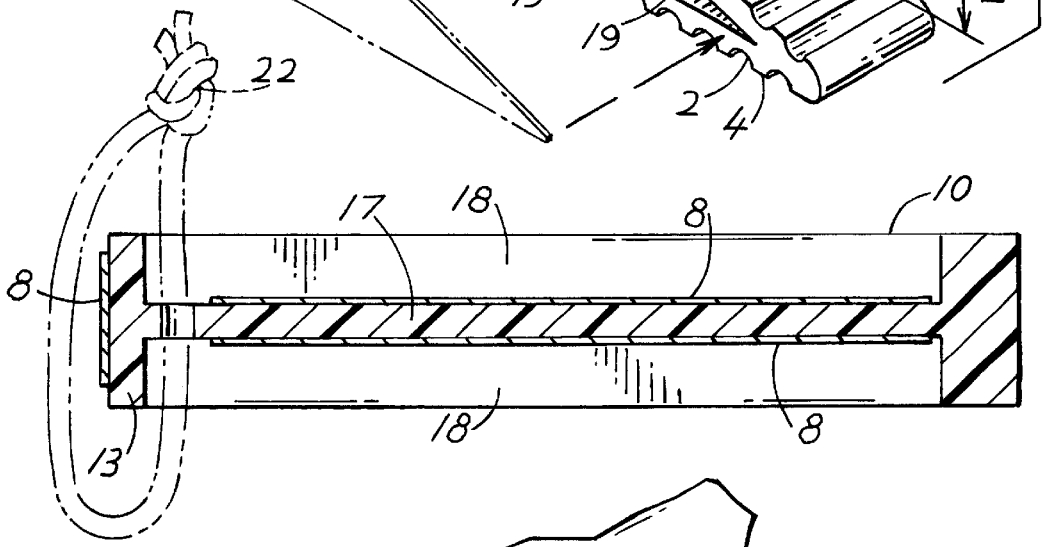
FIG. 2 is a top plan and sectioned view of the wedge shown in FIG. 1 and taken along Line 2—2 of FIG. 1.

Referring now to FIG. 2, it will be noted that the cross sectional shape of the wedge 10 resembles that of an "I-beam." It will also be noted that the first contact face 11 forms the outer surface of the first contact plate and the second contact face 12 forms the outer surface of the second contact plate 16. See also FIG. 1. A centrally situated web 17 runs generally perpendicularly to the first and second contact plates 15, 16 along their respective lengths. In the preferred embodiment, the thickness of the web 17 and the contact plates 15, 16 of the I-beam are 5 mm. To either side of the web 17 are wedge voids 18 that allow for light-weight fabrication of the wedge 10 from a number of phenolic, resin or fiberglass materials. In the experience of this inventor, however, the material selected must be able to withstand high temperature conditions, which in the experience of this inventor can be upwards of 500° Fahrenheit. It must also be capable of withstanding compression forces of a commercial door closer and possess interior cavity tensile forces that might be experienced during the "breaking loose" and turning of a valve. This later requirement is necessary because the forwardmost acute angle portion 19 of each wedge void 18 may be used for such purpose. It should also be understood that the above recitation of the particular dimensions of the I-beam are merely examples of the inventor's preferred dimensions and are not meant to limit the scope of this invention in any way.

In the preferred embodiment, the wedge 10 can be constructed of a brightly colored material such as yellow. In this embodiment, however, the wedge 10 may also be equipped with a number of reflective stickers 8 so that it may be even more easily found in dense smoke even where the wedge is constructed of a conventional black material. See FIGS. 1 and 2. The reflective stickers should likewise be able to withstand high temperature environments.

Figure 3:
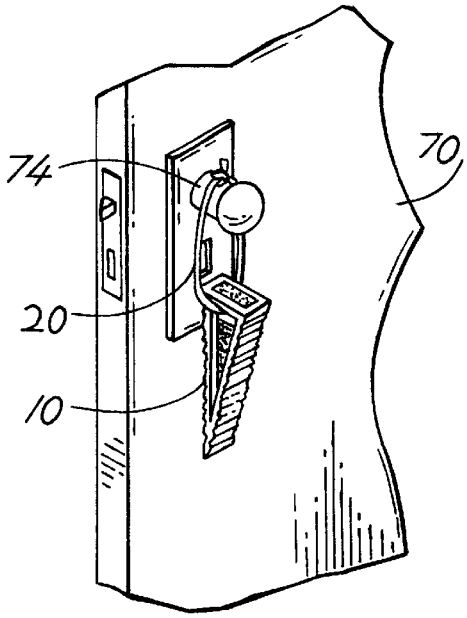
FIG. 3 is a partial view of a door and doorknob upon which is suspended a wedge and rope lanyard of the assembly of the present invention.

Lastly, the web 17 of the wedge 10 has an aperture 6 defined generally adjacent the non-contact face 13. The rope lanyard 20 is threaded through this aperture 6 and is secured at each end by means of a knot 22. The rope lanyard 20 merely serves to attach to the wedge 10 to the rope clip 30. The rope lanyard 20 should be long enough so that it can hang on a doorknob or a similar object so that a firefighter can use the wedge 10 as a marker or room search indicator. See FIG. 3.

The rope clip 30 is a generally flat flexible ring-like object with a first end 32 containing an aperture 34 and a second end 36 containing a quick release opening 38. See FIG. 7. The importance of the flexibility of the rope clip 30 will become apparent in the next paragraph of this detailed description. The aperture 34 provides an opening for the rope clip retention ring 40 so that the ring 40 holds a number of rope clips 30 securely to the carabiner 50. As previously discussed, the rope clips 30 may be secured directly to the carabiner 50 without use of a rope clip retention ring 40.

The quick release opening 38 of the rope clip 30 consists of an extremely narrow opening slit 35 that widens into a generally circular aperture 37. This circular aperture 37 has a slightly larger diameter than the rope lanyard 20 so as to accommodate the rope lanyard 20. The opening slit 35 should be narrow enough and rigid enough so as to prevent the rope lanyard 20 from escaping the rope clip 30 due to the force of gravity in addition to the forces caused by the normal jostling it will receive during firefighting activities. The opening slit 35 and generally circular aperture 37 form a pair of contacts 39 on each side of the opening slit 35. The contacts 39, which are generally coplanar, should be flexible enough so that, when urged away from one another, the rope lanyard 20 can be removed from the rope clip 30 by simply applying an intentional pulling force to the wedge 10. It is optimal, in the view of this inventor, that each rope clip 30 be fabricated of such material so as to allow the clip 30 to withstand an almost unlimited number of deployments.

The rope clip retention ring 40 attaches through the aperture 34 of the rope clip 30 and may also be attached to the carabiner 50. See FIG. 7. The carabiner 50 consists of a standard carabiner with a generally C-shaped body 51 that uses a spring-loaded hinge 52 to transform the C-shape into a closed system. The carabiner 50 is used to clip the assembly 1 to the fireman's belt 60.

Figure 4:
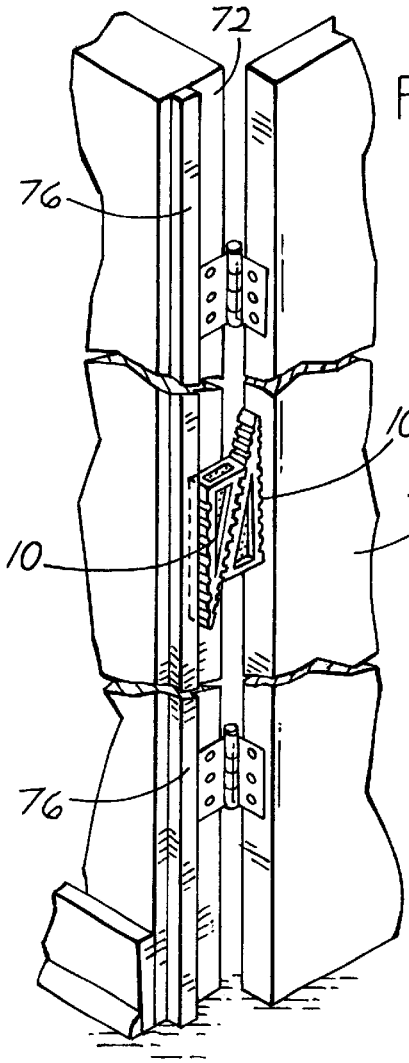
FIG. 4 is a perspective view of a door and jamb showing a pair of wedges being used in tandem to secure the door in an open position.
Figure 5:
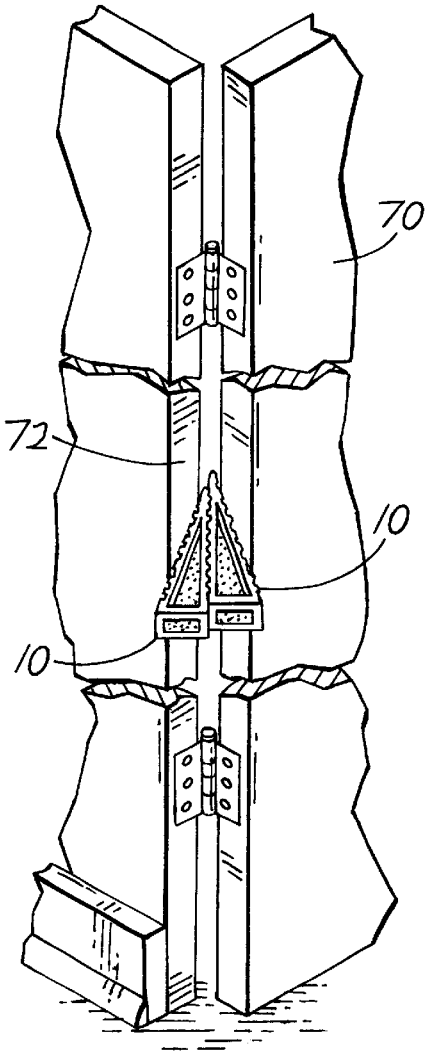
FIG. 5 is a perspective view of a door and jamb showing another pair of wedges being used in tandem to secure the door in an open position.
Figure 6:
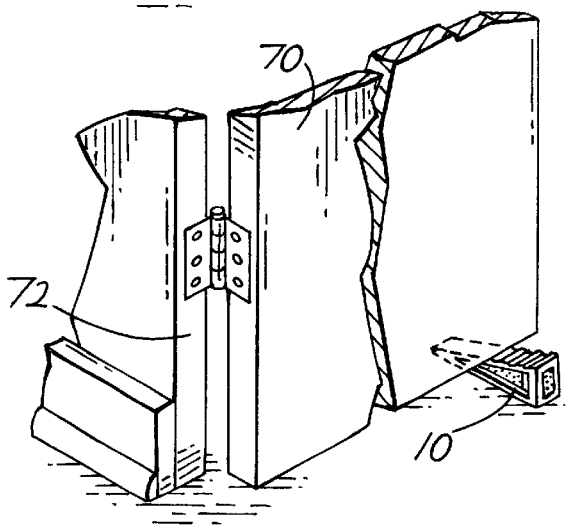
FIG. 6 is a partial perspective view of the door and jamb shown in FIG. 6 and showing a single wedge used to secure the door in an open position.

In application, the assembly 1 is attached to the belt 60 of a firefighter as illustrated in FIG. 9. The attachment is made to the belt 60 by means of the assembly carabiner 50. Suspended from the carabiner 50 is a rope clip retention ring 40. Attached to the retention ring 40 is a plurality of rope clips 30. Alternatively, a plurality of rope clips 30 may be attached directly to the carabiner 50 or to the retention ring 40 without the carabiner 50. Each rope clip 30 has removably attached to it a rope lanyard 20 and a wedge 10. As the firefighter enters the firefighting situation, the firefighter may "mark" a room the way by deploying one wedge 10 at a time and hang such wedge 10 on a doorknob 74. See FIG. 3. The firefighter may also use a deployed wedge 10 to hold a door 70 open, as shown in FIGS. 4, 5 and 6. With respect to the situation where a pair of wedges 10 are used in tandem, as shown in FIGS. 4 and 5, for example, the two contact faces 11, 12 of the wedges 10 engage each other in a non-slip relation. FIG. 5 illustrates a pair of wedges 10 inserted between a door 70 and jamb 72 at the point of maximum door flex. FIG. 4 illustrates a pair of wedges 10 similarly inserted between a door 70 and door jamb elements 72, 76. This is accomplished by the alternating arcuate indentations 2 and ridges 4 defined within each of the contact faces 11, 12. The arcuate indentations 2 of the first contact face 11 of a first wedge 10, for example, engage the ridges 4 of the first or second contact face 11, 12 of a second wedge 10. This arcuate indentation 2 and ridge 4 design of the preferred embodiment provides a multi-angled surface area for each contact face 11, 12 so that the wedge 10 can be easily positioned for maximum surface engagement between the door 70 and door jamb 72 as shown in FIG. 4.

From the foregoing detailed description of the illustrative embodiment of the invention set forth herein, it will be apparent that there has been provided a new, useful and uncomplicated wedge and wedge deployment assembly for firefighters that can be used by them to mark the searched areas of a building, holds doors open, is readily reusable, can be easily and conveniently carried and removed from the belt of a firefighter, withstands high temperatures and can be used as a tool to open and close valves.

Parts List

1. Assembly
2. Indentation
4. Ridge
6. Aperture
8. Reflective stickers
10. Firefighter's wedge
11. Contact face
12. Contact face
13. Non-contact face
15. Contact plate
16. Contact plate
17. Web
18. Wedge voids
19. Angle portion
20. Rope lanyard
22. Knot
30. Rope clip
32. End
34. Aperture
35. Slit
36. End
37. Aperture
38 Release opening
39. Flanges
40. Rope clip retention ring
50. Carabiner
51. C-shaped body
52. Hinge
60. Fireman's belt
70. Door
72. Doorjamb
74. Door knob
76. Doorjamb The principles of this invention having been fully explained in connection with the foregoing, I hereby claim as my invention:

1. A wedge for use by firefighters comprising a triangularly shaped wedge having a first wedge face and a second wedge face with an alternating series of ridges and indentations defined within each of the first wedge face and the second wedge face, the alternating series of ridges and indentations of each wedge face being engageable with the alternating series of ridges and indentations defined within the face of a like-configured adjacent wedge to prevent slidable movement therebetween and said wedge further having an aperture at one end, and a rope lanyard that fits through the aperture wherein a plurality of such wedges may be placed atop one another without slideable movement between them.

2. The firefighter wedge of claim 1 wherein the first wedge face and the second wedge face lie in planes that form an acute angle relative to one another.

3. The firefighter wedge of claim 2 including a central support web that extends between each of said planar faces, said web laying in a plane that is generally perpendicular to each of said faces.

4. The firefighter wedge of claim 3 including a wedge void situated to either side of said central support web.

5. The firefighter wedge of claim 4 wherein each wedge is constructed of a phenolic, resin or fiberglass material.

6. The firefighter wedge of claim 5 wherein each wedge may be brightly colored to make the wedge more easily seen in low visibility situations.

7. The firefighter wedge of claim 6 wherein each wedge may have one or more reflective and adhesive stickers attached to various surfaces of the wedge to make the wedge more easily seen in low visibility situations.

8. The firefighter wedge of claim 7 wherein each wedge and any stickers attached to it are able to withstand high temperatures.

9. The firefighter wedge of claim 8 including a flexible rope clip with a first end featuring an aperture and a second end featuring a pair of oppositely facing generally identical flanges with said flanges forming an opening slit and a generally circular aperture to contain the rope lanyard, a carabiner, and a rope clip retention ring attached at a first end through the aperture in the rope clip and at the other end to the carabiner.

10. The firefighter wedge of claim 8 including a flexible rope clip with a first end featuring an aperture and a second end featuring a pair of oppositely facing generally identical flanges with said flanges forming an opening slit and a generally circular aperture to contain the rope lanyard, and a carabiner, said rope clip being attachable to said carabiner.

11. The firefighter wedge of claim 8 including a flexible rope clip with a first end featuring an aperture and a second end featuring a pair of oppositely facing generally identical flanges with said flanges forming an opening slit and a generally circular aperture to contain the rope lanyard, and a rope clip retention ring, said rope clip being attachable to said retention ring.

12. A wedge deployment assembly for use by a firefighter, such firefighter wearing a belt or other support means, which assembly comprises a plurality of triangularly shaped wedges, each such wedge having at least two planar faces, said planar faces laying at an acute angle relative to one another, and each of said planar faces having a series of ridges and arcuate indentations defined within the face, said ridges and indentations being uniformly spaced along said face and being engageable with ridges and indentations defined within the face of an adjacent wedge to prevent slidable movement between the faces of adjacent wedges, wherein the plurality of such wedges may be placed one atop the other, a plurality of rope lanyards, one such lanyard being attached to each wedge, a carabiner or retention ring, said carabiner or retention ring being removably attachable to said belt or other support means, and a plurality of means for quickly and easily releasing the wedges and rope lanyards from the carabiner or retention ring.

13. The wedge deployment assembly of claim 12 wherein said means for releasing the wedge and rope lanyard includes at least one flexible rope clip interposed between said carabiner or retention ring and said rope lanyards.

14. The wedge deployment assembly of claim 13 wherein said rope clip includes a first end and a second end and further includes an aperture at said first end and an opening slit at said second end that widens into a generally circular aperture to accommodate the rope lanyard such that the rope lanyard can be removed from the rope clip through said opening slit by a pulling force applied to the wedge or to the rope lanyard.

15. The wedge deployment assembly of claim 14 wherein each wedge includes a central support web that extends between each of said planar faces, said web laying in a plane that is generally perpendicular to each of said faces.

16. The wedge deployment assembly of claim 15 wherein each wedge includes a wedge void situated to either side of said central support web.

17. The wedge deployment assembly of claim 16 wherein each wedge is constructed of a phenolic, resin or fiberglass material.

18. The wedge deployment assembly of claim 17 wherein each wedge may be brightly colored to make the wedge more easily seen in low visibility situations.

19. The wedge deployment assembly of claim 18 wherein each wedge may have one or more reflective and adhesive stickers attached to various surfaces of the wedge to make the wedge more easily seen in low visibility situations.

20. The wedge deployment assembly of claim 19 wherein each wedge and any stickers attached to it are able to withstand high temperatures.

21. The wedge deployment assembly of claim 20 wherein said means for releasing the wedge and rope lanyard includes both a rope clip retention ring and a carabiner, said rope clip retention ring being interposed between said carabiner and said rope clip.

* * * * *